US005394661A

United States Patent [19]

Noble

[11] Patent Number: 5,394,661

[45] Date of Patent: Mar. 7, 1995

[54] EARTHQUAKE RESISTANT BIOSPHERE

[76] Inventor: Curtis R. Noble, 1451 Cottage Ave., Pocatello, Id. 83201

[21] Appl. No.: 80,496

[22] Filed: Jun. 24, 1993

[51] Int. Cl.[6] ..... E02D 27/34

[52] U.S. Cl. ..... 52/167.4; 52/1; 52/81.1; 52/167.1

[58] Field of Search ..... 52/81.1, 167 R, 167 RM, 52/1

[56] References Cited

U.S. PATENT DOCUMENTS

| | | | |
|---|---|---|---|
| 2,166,577 | 7/1939 | Beckius | 52/167 R X |
| 3,841,039 | 10/1974 | Farnsworth | 52/81.1 |
| 3,916,578 | 11/1975 | Forootan et al. | 52/167 R |
| 4,049,195 | 9/1977 | Rugenstein | 52/81.1 X |
| 4,067,153 | 1/1978 | Davis | 52/81.1 |
| 4,228,788 | 10/1980 | Moeser | 52/66 X |
| 4,565,149 | 1/1986 | Clasky | 52/81.1 X |

*Primary Examiner*—Carl D. Friedman
*Assistant Examiner*—Beth A. Aubrey
*Attorney, Agent, or Firm*—Tod R. Nissle

[57] ABSTRACT

A building structure can, in the event of an earthquake, be quickly released to roll freely over the ground. Living quarters are suspended in the building structure. The living quarters remain in an upright orientation while the building structure rolls over the ground.

3 Claims, 3 Drawing Sheets

EARTHQUAKE RESISTANT BIOSPHERE

This invention pertains to building structures.

More particularly, the invention pertains to a building structure which is not permanently anchored to the ground.

In another respect, the invention pertains to a building structure which can, in the event of an earthquake or movement of the ground beneath the building structure, be quickly released to roll freely over the ground.

In still a further respect, the invention pertains to a building structure which rolls freely over the ground while maintaining living quarters suspended in the building structure in a normal upright orientation.

The forces generated during an earthquake are enormous. Most man made structures, especially small residential structures, cannot successfully resist the forces generated during a major earthquake. Building structures often collapse during a major earthquake, killing or injuring individuals caught inside the structures.

Accordingly, it would be highly desirable to provide an improved building structure which would more effectively protect the inhabitants of the structure and protect the integrity of the structure during an earthquake or during other movement of the ground on which the structure is resting.

Therefore, it is a principal object of the invention to provide an improved building structure.

A further object of the invention is to provide an improved building structure which minimizes damage to the building structure during an earthquake.

Another object of the invention is to provide an improved building structure including living quarters which are maintained in a selected orientation during movement of the earth upon which the building structure rests.

Still a further object of the invention is to provide an improved building structure which can move freely over the earth during an earthquake and which need not be permanently anchored in bedrock.

Yet still another object of the invention is to provide an improved building structure which can be sealed and disconnected from utility lines during the occurrence of an earthquake.

These and other, further and more specific objects and advantages of the invention will be apparent to those skilled in the art from the following detailed description thereof, taken in conjunction with the drawings, in which.

Briefly, in accordance with my invention, I provide an improved building structure including a hollow support structure shaped and dimensioned to roll over the ground; and, a self righting inner living structure mounted in said outer support structure such that said living structure maintains a selected upright orientation when said support structure rolls over the ground.

In another embodiment of my invention, I provide an improved building structure including a hollow support structure shaped, contoured, and dimensioned to roll over the ground; an attachment system for releasably anchoring the support structure to the ground; means for operating the attachment system to release the support structure to roll freely over the ground; and, a living structure mounted inside the support structure.

In still another embodiment of my invention, I provide an improved building structure including a hollow support structure shaped to roll over the ground; an inner living structure mounted in the support structure and including a housing structure with a curved outer surface, and means extending between the support structure and the hollow structure to contact the curved outer surface and turn the living structure with respect to the support structure.

Figure 1:
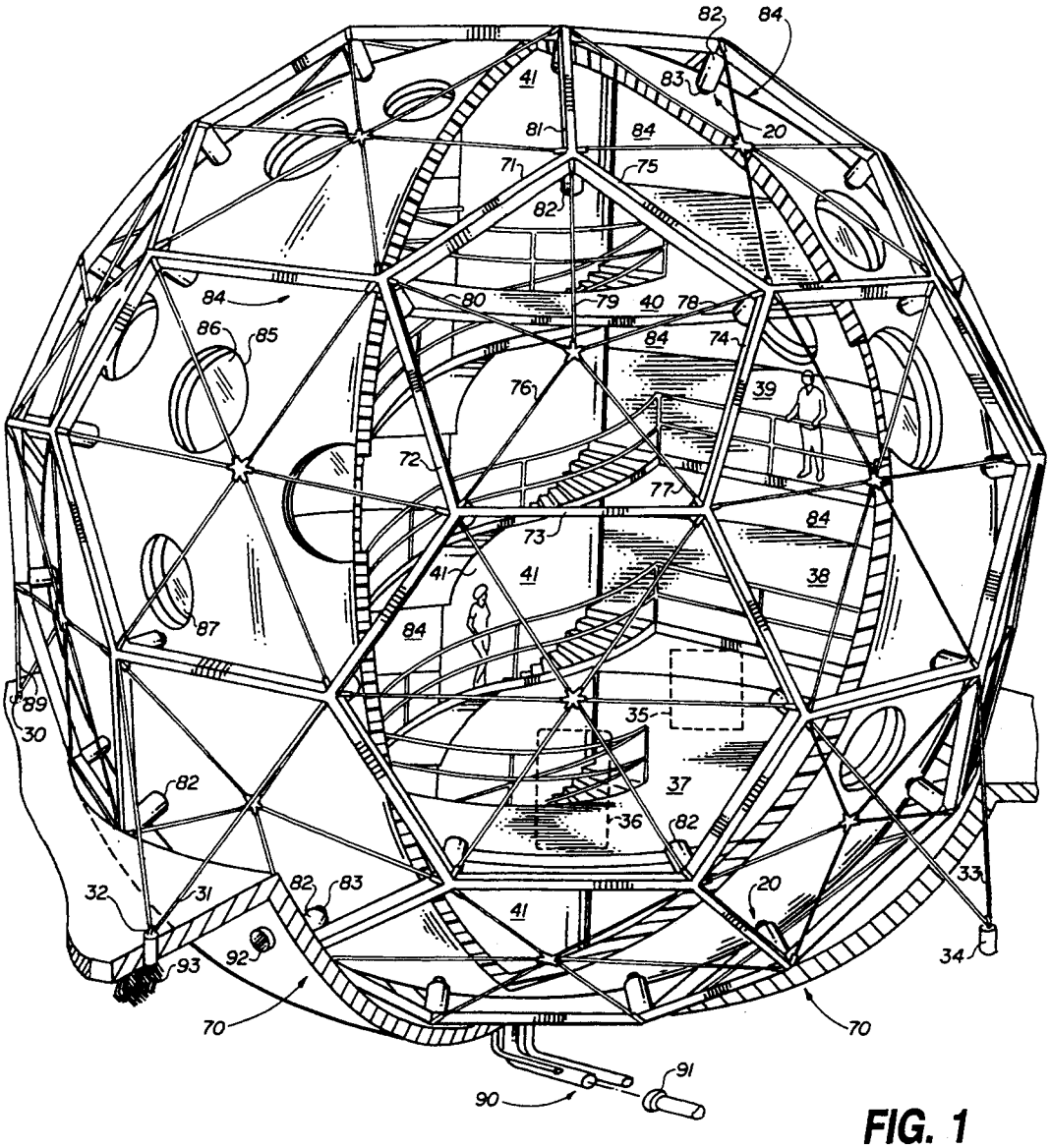
FIG. 1 is a perspective section view illustrating a building structure constructed in accordance with the principles of the invention.

Turning now to the drawings, which depict the presently preferred embodiments of the invention for the purpose of illustrating the practice thereof and not by way of limitation of the scope of the invention, FIG. 1 illustrates a spherical building structure resting in a concrete bowl or nest 70. The building structure includes a hollow spherical geodesic sphere superstructure comprised of a plurality of interconnected structural members which form hexagonal, pentagonal, or other geometric shapes. For example, in FIG. 1, elongate structural members 71 to 75 form a pentagon in the geodesic sphere. Structural member 73 also forms one leg of a hexagon directly beneath the pentagon just mentioned. The structural members which form the geodesic sphere are fabricated from metal or any other desirable material. Tensioned cables 76 to 80 provide additional support for interconnected structural members 71 to 75. A roller unit 20 is mounted at each junction of three structural members. Each roller unit 20 includes a motor assembly 82 which controls and turns a roller 83 mounted in the motor assembly 82. The roller 83 contacts the smooth outer surface of biosphere 84. For example, a roller unit is mounted at the juncture of elongate structural members 71, 75, and 81. Numerous roller units 20 are visible in FIG. 1 and project inwardly from the geodesic sphere. These roller units form one portion of the living structure mounted inside the geodesic sphere of FIG. 1.

Another portion of the living structure comprises a sphere or biosphere 84 including a plurality of openings formed therein to receive windows. For example, circular openings 85 and 88 receive circular windows 86 and 87. Windows 86 and 87 have, as do the remaining windows in biosphere 84, an outer curvature which conforms to the curvature of the outer surface of sphere 84 such that a roller 83 can smoothly roll from the outer surface of sphere 84 onto and over a window 86 and 87. An entry door 36 is formed in and through sphere 84. Door 36 also has a curvature which conforms to the curvature of the outer surface of sphere 84 such that a roller 83 can smoothly roll from the outer surface of sphere 84 onto and over a window 86 and 87. Circular horizontally oriented floors 37 to 40 extend intermediate and interconnect hollow cylindrical hub 41 and sphere 84. The length or height of hub 41 equals the inner diameter of sphere 84. As shown in FIG. 1, the floors 37 to 40 are interconnected by stairways. If desired, an elevator can be installed in hollow hub 41 and stop at each or at selected ones of floors 37 to 40.

Umbilical lines 90 deliver water and electricity to sphere 84. Lines 90 extend upwardly through hub 41 to deliver water and electricity to each desired floor 37 to 40. Each umbilical line 90 is provided with a quick disconnect 91 which can be manually operated or automatically operated by a control unit 35.

Structural moment detector 92 is utilized to determine deformation in nest 70 which can result when an earthquake causes ground supporting nest 70 to fall or move away from nest 70. This information can be utilized to determine the strength or presence of an earthquake. Numerous other well known sensor systems, either adjacent, in, or remote from the building structure of FIG. 1 can be utilized to determine the occurrence of an earthquake and/or the movement of the ground support nest 70 and the building structure of FIG. 1. These sensor systems are in communication with the control system 35 via hard wiring, via radio wave, via microwave, via fiber optics, etc.

Tether lines 89, 31, and 33 anchor the geodesic sphere to quick release units 30, 32, and 34. Units 30, 32, and 34 are secured in concrete, in the ground, or are otherwise fixedly anchored at locations adjacent the geodesic sphere. Units 30, 32, 34 are in communication with the control system 35 via hard wiring, via radio wave, etc. While units 30, 32, 34 can be hand operated to release tether line 89, 31, 33, it is preferred that such a release be controlled and triggered by control unit 35.

Figure 2:
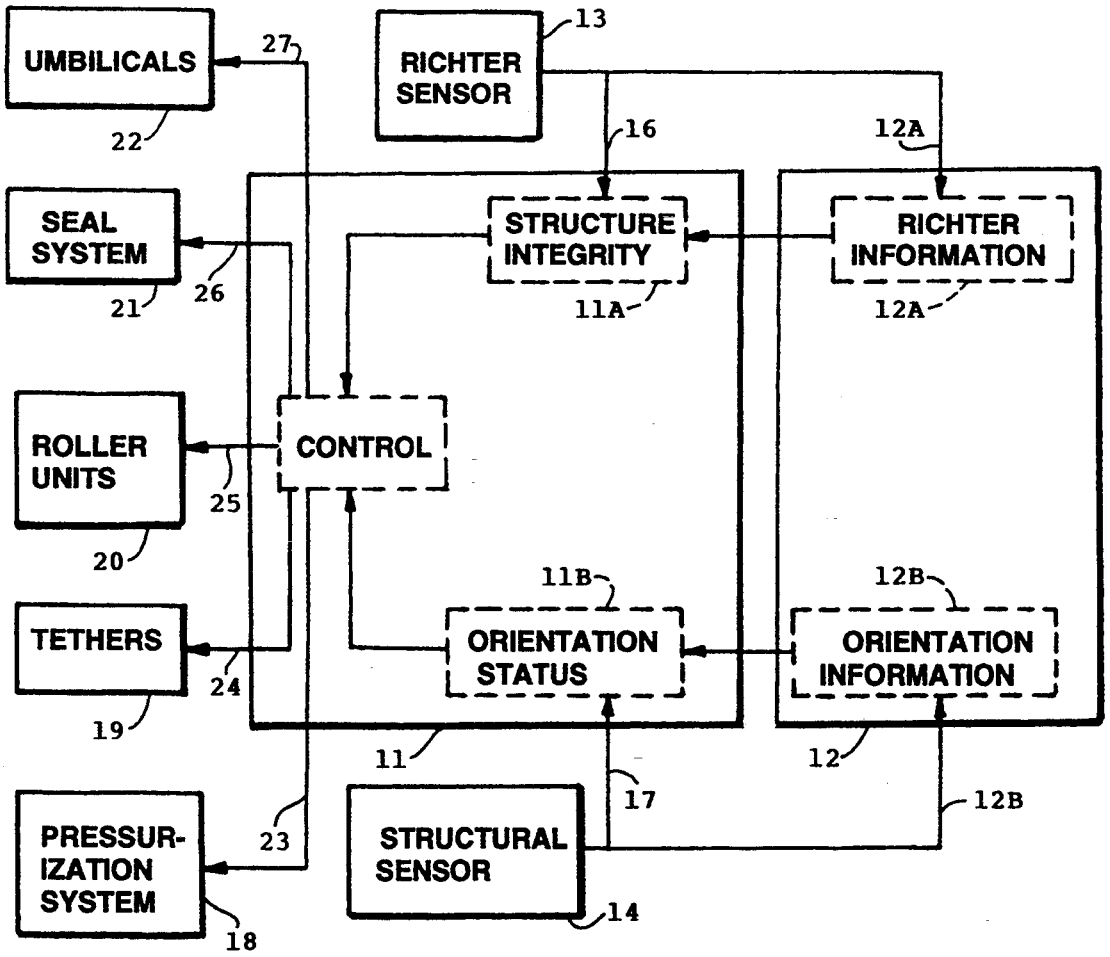
FIG. 2 is a schematic block diagram illustrating the control system for the building structure of FIG. 1; and, FIG. 3 is a block flow diagram illustrating a typical logic utilized by the control system of FIG. 2.

Control unit 35 is located on floor 37 and, as illustrated in FIG. 2, includes a controller 11, memory 12, structural sensor 14, Richter sensor 13, a system for sealing the windows and doors of sphere 84, and a system for increasing the pressure inside sphere 84 to strengthen sphere 84 against compressive forces which squeeze the geodesic sphere and sphere 24 when the building structure of FIG. 1 rolls over the ground. Systems for increasing the air pressure in a sealed area are well known in the art, as are systems for sealing windows and doors. Preferably, control unit 35 automatically controls the opening and closing of windows 86, 87 and door(s) 36 so that in the event of an earthquake, unit 35 can close and seal the windows and doors in sphere 84 to seal sphere 84. Control unit 35 communicates with windows and doors 36 in sphere 24 via hard wiring, microwave, etc. For example, wiring can, during the construction of sphere 84, be integrally formed in sphere 84 and extend from unit 35 to each window and door. The structural sensor 14 indicates the spatial orientation of sphere 84. Sensor 14 can comprise a bubble level or any other sensor for detecting changes in orientation of sphere 84 from the normal upright orientation shown in FIG. 1. Control 11 communicates with the roller units 20 via hard wiring, microwave, etc. Wiring can extend from unit 35 to units 20 through the structural members 71 to 75, etc. which form the geodesic sphere.

The memory 12 includes Richter information 12A and orientation information 12B. The Richter information 12A is provided by a Richter sensor 13 such as the structural moment detector 92 or any other sensor which is incorporated in the building structure or in the ground adjacent the building structure. Richter information 12A can also, if desired, be provided by sensors which are remote from the building structure and provide advance information concerning the possible occurrence of an earthquake or of movement of the ground beneath or adjacent the building structure.

The orientation information 12B is provided by a bubble level or by another sensor system mounted on or in sphere 24, in roller units 20, or in the geodesic sphere which indicates the orientation of sphere 24. The orientation information indicates movement of sphere 24 from the normal desired upright orientation illustrated in FIG. 1.

In operation, the building structure of FIG. 1 is in the configuration shown in FIG. 1 with tethers 89, 31, and 33 securing the geodesic dome in nest 70 and with umbilicals 90 connected and delivering water and electricity to sphere 24. Umbilicals 90 also remove waste water from sphere 24. In the event of an earthquake or another event which causes the ground 93 supporting the nest 70 and building structure to give way, the Richter sensor 13 generates data 12A for memory 12. The structure integrity sub-routine 11A analyzes this data to determine whether the magnitude of the earthquake or of movement of the earth justifies setting the spherical building structure of FIG. 1 loose so it can, if necessary, roll freely over the ground. The criteria which the structure integrity subroutine uses to make this decision can vary as desired. For example, a determination of a local earthquake with a Richter value in excess of 6.0 may be sufficient to trigger unit 35 to free the geodesic sphere. Or, the detection by moment detector 92 of movement in excess of a selected value may trigger the freeing of the geodesic sphere. Once, however, the control unit elects to free the building structure, unit 35 sends out several commands. First, the controller 11 signals 26 the seal system 21 to close all doors and windows. Sealing the biosphere 84 enables to biosphere 84 and geodesic sphere to float. Second, controller 11 activates 23 the pressurization system 18 to increase the pressure in sphere 24. Third, controller 11 signals 24 units 30, 32, and 34 to release tether lines 89, 31, and 33, respectively. Fourth, controller 11 signals 27 the quick release connection 91 for each umbilical line to activate and disconnect from the portion of the umbilical line extending into sphere 24. Fifth, in the event the geodesic sphere begins to roll, controller 11 sends appropriate signals 25 to the roller units 20 to turn sphere 24 to maintain sphere 24 in the orientation illustrated in FIG. 1. If desired, ballast can be stored in the bottom of sphere 24 such that if rollers 83 are permitted to roll freely, the ballast tends to maintain sphere 24 in the geodesic sphere in the orientation shown in FIG. 1 while the geodesic sphere rolls over the ground.

Figure 3:
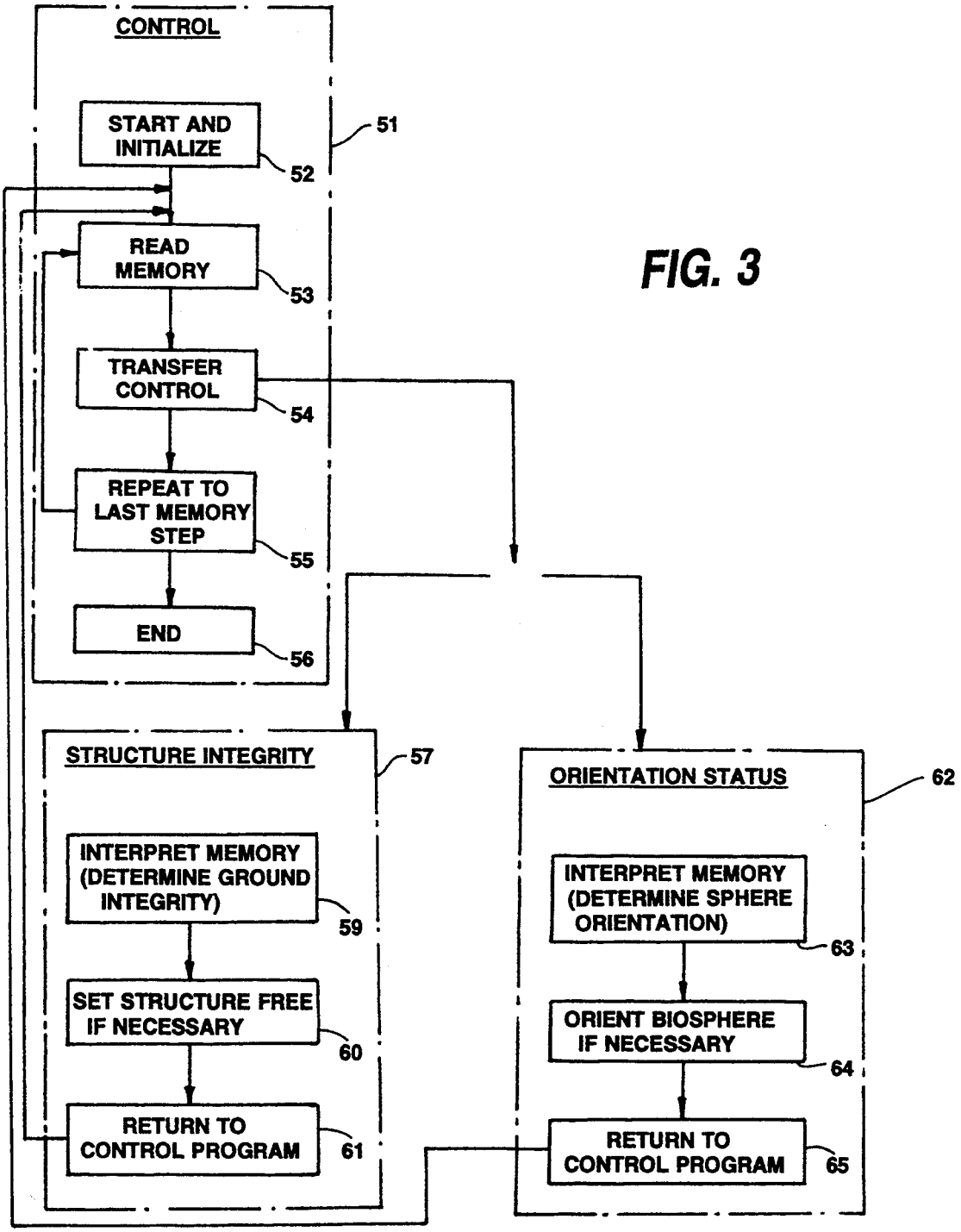

A typical logic flow chart utilized by controller 11 is illustrated in FIG. 3 and includes a control program 51, structure integrity 57 sub-routine, and orientation status 62 sub-routine. The control program 51 includes the step "start and initialize" 52 followed by "read memory" 53 and "transfer control" 54 to the structure integrity 57 or orientation status 62 subroutines. The structure integrity sub-routine includes the steps of "interpret memory" 59 (i.e., determine the ground integrity and whether an earthquake is occurring) and "set building structure free if necessary" 60. During step 60, if it is necessary to set the building structure free, the umbilicals 90 are released, the tethers are released, etc. Step 60 is followed by "return to control program" 61.

The orientation status 62 sub-routine includes the steps of "interpret memory" 63 (i.e., determine the biosphere orientation) and "orient biosphere if necessary" 64. Orientation or rotation of the biosphere 84 in the geodesic sphere is presently accomplished by the driven rollers 23 in roller units 20. Step 24 is followed by "return to control program" 65. In the control program 51 "transfer control" 54 is followed by "repeat to last memory step" 55 and "end" 56.

The lowest internal level of the biosphere 84 can also include water tanks, utility trunks, emergency oxygen supplies, and selected heavy appliances. One of the levels of the biosphere 84 can serves as an atrium or garden.

Having described my invention in such terms as to enable those of skill in the art to understand and practice it and having described the presently preferred embodiments thereof, I claim:

1. A building structure including (a) a hollow support structure shaped, contoured, and dimensioned to roll over the ground; and, (b) a self righting inner living structure mounted in said outer support structure such that said living structure maintains a selected upright orientation when said support structure rolls over the ground.

2. A building structure including (a) a hollow support structure shaped, contoured, and dimensioned to roll over the ground;

(b) attachment means releasably anchoring said support structure to the ground;

(c) means for releasing said attachment means to permit said spherical support structure to roll freely over the ground; and, (d) a living structure mounted inside said support structure.

3. A building structure including (a) a hollow support structure shaped, contoured, and dimensioned to roll over the ground;

(b) an inner living structure mounted in said support structure and including (i) a housing structure with a curved outer surface, and (ii) means extending between said support structure and said hollow structure to contact said curved outer surface and turn said living structure with respect to said support structure.

* * * * *